US007438060B2

(12) United States Patent
Mc Lain

(10) Patent No.: US 7,438,060 B2
(45) Date of Patent: Oct. 21, 2008

(54) SYSTEM FOR DETECTING PURGE VALVE MALFUNCTION

(75) Inventor: Kurt D. Mc Lain, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 39 days.

(21) Appl. No.: 11/560,986

(22) Filed: Nov. 17, 2006

(65) Prior Publication Data

US 2008/0135025 A1 Jun. 12, 2008

(51) Int. Cl.
*F02M 33/02* (2006.01)

(52) U.S. Cl. ..... 123/519; 123/520

(58) Field of Classification Search ..... 123/516, 123/518–520; 73/49.2, 118.1
See application file for complete search history.

(56) References Cited

U.S. PATENT DOCUMENTS 4,012,944 A * 3/1977 Covington et al. ..... 73/40.5 R
4,608,857 A * 9/1986 Mertens et al. ..... 73/40.5 R
4,715,214 A * 12/1987 Tveter et al. ..... 73/49.2
5,361,622 A * 11/1994 Wall ..... 73/49.2
5,750,888 A * 5/1998 Matsumoto et al. ..... 73/118.1
6,016,690 A * 1/2000 Cook et al. ..... 73/49.2
6,164,123 A * 12/2000 Corkill ..... 73/49.7
6,311,548 B1 * 11/2001 Breidenbach et al. ..... 73/40
6,880,383 B2 * 4/2005 Mc Lain et al. ..... 73/49.2

* cited by examiner

*Primary Examiner*—Thomas N Moulis

(57) ABSTRACT

A diagnostic control system for a purge valve that regulates fuel vapor flow from a fuel system into an intake manifold for an engine includes a calculation module and a malfunction module. The calculation module estimates a plurality of areas based on a plurality of pressure signals and calculates an average rate of increase of vacuum pressure in the fuel system during operation of the purge valve. The malfunction module determines whether the average rate of increase of vacuum pressure is within a predetermined range generating a purge valve functioning signal, and generates a purge valve malfunction signal when the average rate of increase of vacuum pressure is not within the predetermined range.

16 Claims, 5 Drawing Sheets

SYSTEM FOR DETECTING PURGE VALVE MALFUNCTION

FIELD OF THE INVENTION

The present invention relates to a purge valve in an evaporative emissions system, and more particularly to a control system that detects a malfunctioning purge valve.

BACKGROUND OF THE INVENTION

A vehicle typically includes a fuel tank that stores liquid fuel such as gasoline, diesel, methanol or other fuels. The liquid fuel may evaporate into fuel vapor which increases pressure within the fuel tank. Evaporation of fuel is caused by energy transferred to the fuel tank via radiation, convection, and/or conduction. An evaporative emissions control (EVAP) system is designed to store and dispose of fuel vapor to prevent release. More specifically, the EVAP system returns the fuel vapor from the fuel tank to the engine for combustion therein.

The EVAP system includes an evaporative emissions canister (EEC) and a purge valve. When the fuel vapor increases within the fuel tank, the fuel vapor flows into the EEC. A purge valve controls the flow of the fuel vapor from the EEC to the intake manifold. The purge valve may be modulated between open and closed positions to adjust the flow of fuel vapor to the intake manifold. Improper operation of the purge valve may cause a variety of undesirable conditions such as: idle surge, steady throttle surge, or undesirable emission levels.

SUMMARY OF THE INVENTION

A diagnostic control system for a purge valve that regulates fuel vapor flow from a fuel system into an intake manifold for an engine according to the present invention includes a calculation module and a malfunction module. The calculation module estimates a plurality of areas based on a plurality of pressure signals and calculates an average rate of increase of vacuum pressure in the fuel system during operation of the purge valve. The malfunction module determines whether the average rate of increase of vacuum pressure is within a predetermined range and generates a purge valve malfunction signal when the average rate of increase of vacuum pressure is not within the predetermined range.

In other features, the calculation module includes an area calculation module and an average slope module. The area calculation module calculates a plurality of estimated areas based on the plurality of areas. The average slope module determines an average area based on the plurality of estimated areas and calculates the average rate of increase of vacuum pressure based on the average area.

In still other features, the diagnostic control system includes a leak test module that receives a test pressure a test pressure and generates a test pass signal when the test pressure signal remains within a range for a predetermined period. The calculation module calculates the plurality of areas only after receiving the pass test signal.

In yet other features, the purge valve malfunction signal indicates overperformance of the purge valve when the average rate of increase of vacuum pressure is above the predetermined range and underperformance of the purge valve when the average rate of increase of vacuum pressure is below the predetermined range. The predetermined range is based on manifold air pressure, ambient temperature, and fuel tank pressure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. As used herein, the term module or device refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
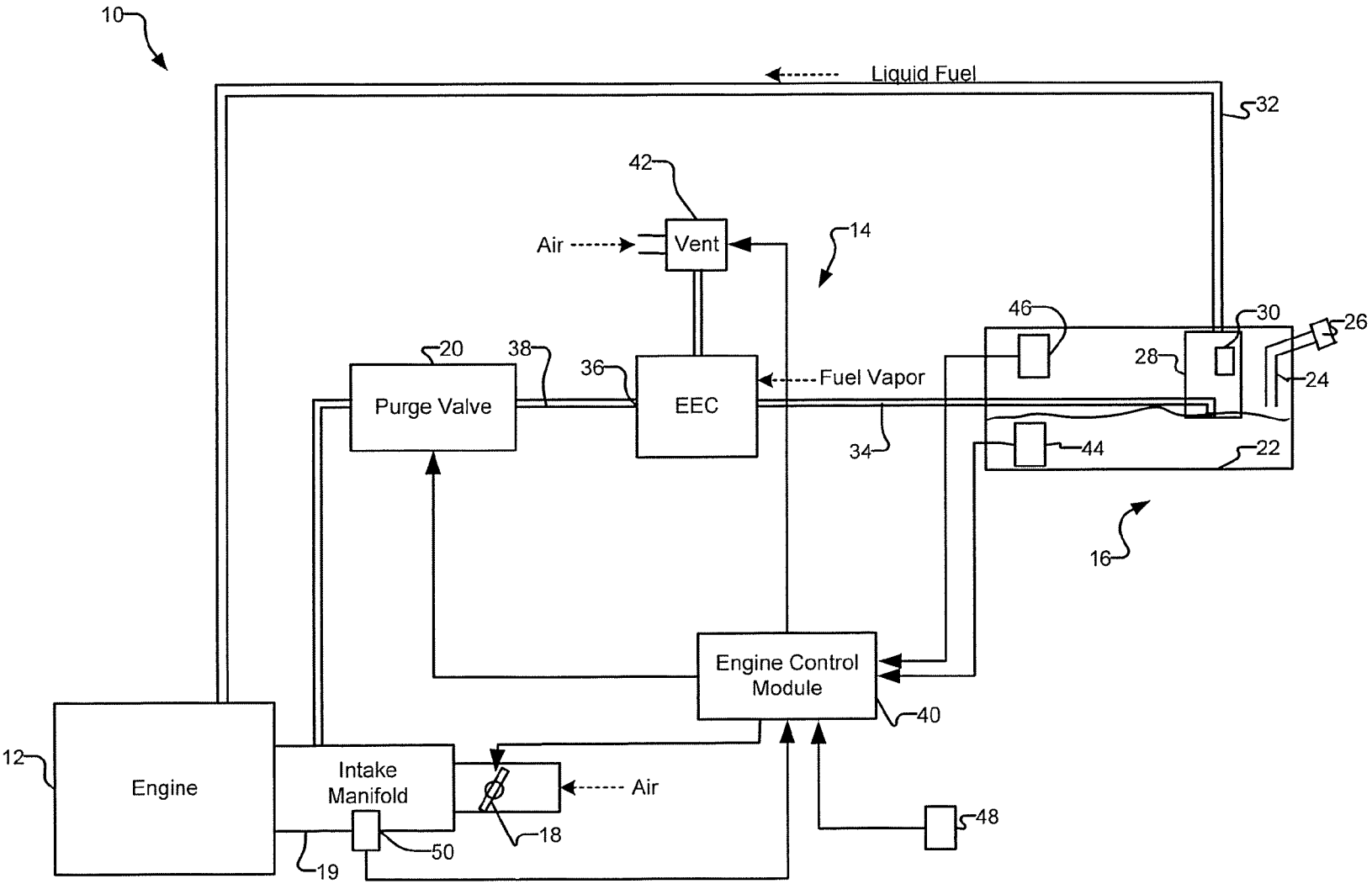
FIG. 1 is a functional block diagram of a vehicle including an evaporative emissions (EVAP) system according to the present invention.

Referring now to FIG. 1, a vehicle 10 includes an engine 12 an evaporative emissions control (EVAP) system 14, and a fuel system 16. A throttle 18 may be adjusted to control the air flow into the intake manifold 19. The air flows from the intake manifold 19 into cylinders (not shown) where it is combined with fuel to form an air/fuel mixture.

The fuel system 16 includes a fuel tank 22 that contains both liquid and vapor fuel. A fuel inlet 24 extends from the fuel tank 22 to an outer portion of the vehicle 10 to enable fuel filling. A fuel cap 26 closes the fuel inlet 24 and may include a bleed tube (not shown). A modular reservoir assembly (MRA) 28 is located inside the fuel tank 22 and includes a fuel pump 30, a liquid fuel line 32, and a fuel vapor line 34. The fuel pump 30 pumps liquid fuel through the liquid fuel line 32 to the engine 12.

Fuel vapor flows through the fuel vapor line 34 to an evaporative emissions canister (EEC) 36. A second fuel vapor line 38 connects the EEC 36 to a purge valve 20. An engine control module (ECM) 40 selectively modulates the purge valve 20 between open and closed positions to allow fuel vapor to flow to an intake manifold 19.

The ECM 40 regulates a canister vent valve 42 to selectively enable air flow from atmosphere to the EEC 36. The ECM 40 receives fuel level and pressure signals from a fuel sensor 44 and a pressure sensor 46 respectively. The ECM 40 periodically determines a range for an average rate of increase of vacuum pressure based on an ambient temperature sensor 48, a MAP sensor 50, and the pressure sensor 46. The MAP sensor 50 determines the air pressure in the intake manifold 19. The ambient temperature sensor 48 monitors the temperature of the surrounding environment. The fuel vapor sensor 46 monitors the vacuum pressure inside the fuel tank 22.

Figure 2:
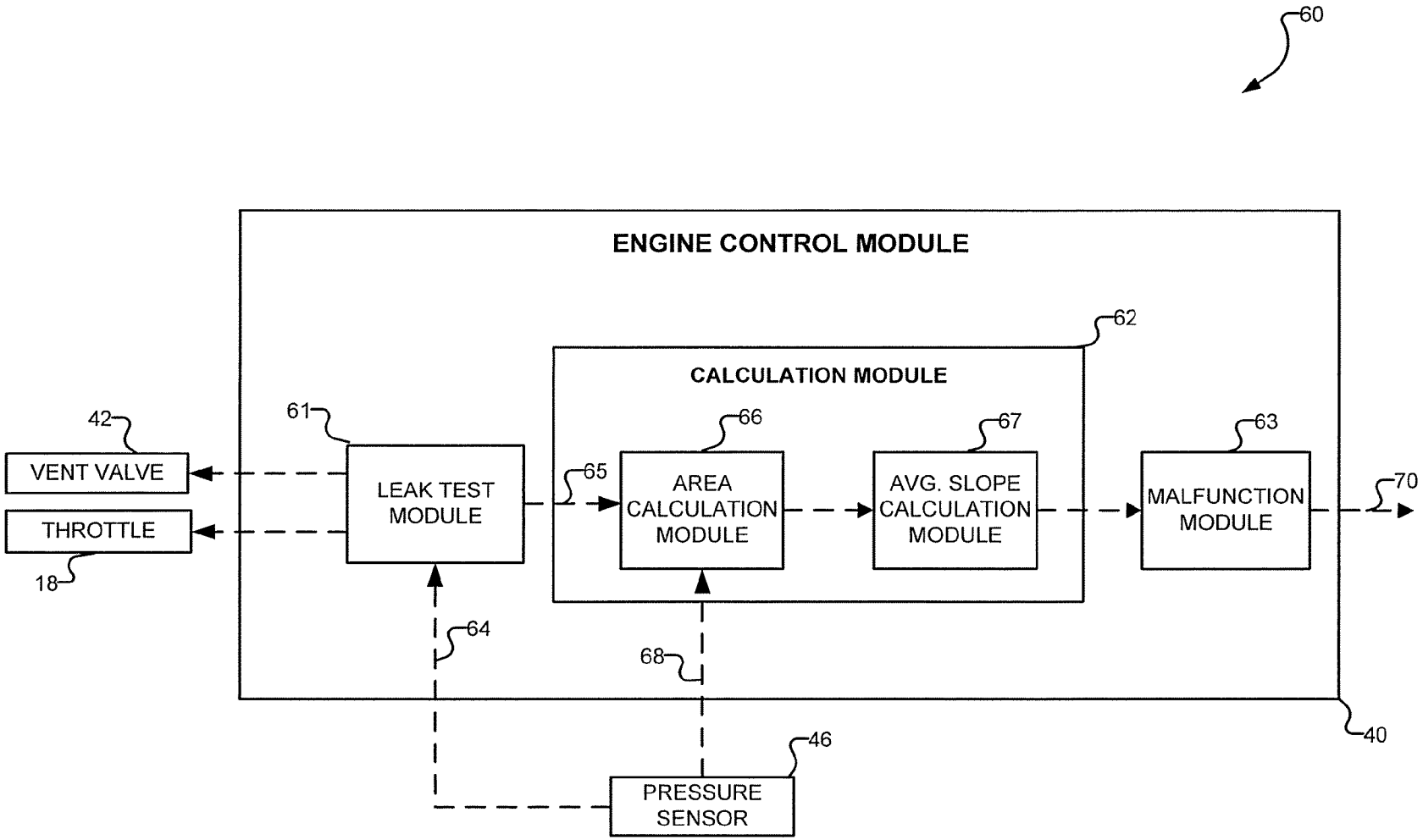
FIG. 2 is a functional block diagram of an engine control module (ECM) according to the present invention.

Referring now to FIG. 2 a functional block diagram 60 illustrates the ECM 40 in further detail. The ECM 40 includes a leak test module 61, a calculation module 62, and a malfunction module 63. The leak test module 61 performs a leak test on the EVAP system 14 prior to determining a purge valve fault. The leak test module 61 adjusts the vent valve 42 and the purge valve 20 to seal the EVAP system 14 during the leak test. The leak test module 61 receives a test pressure signal 64 periodically. If the test pressure signal 64 remains within a test pass range for a predetermined period, the leak test module 61 generates a test pass signal 65.

The calculation module 62 includes an area calculation module 66 and an average slope calculation module 67. The calculation module 62 determines the average rate of increase of vacuum pressure in a fuel tank 22 during a test operation of the purge valve 20. The area calculation module 66 calculates a plurality of areas where each area is determined based on a plurality of pressure signals 68 over a predetermined time interval. The average slope calculation module 67 calculates an average of the plurality of areas, and then calculates the rate of increase of vacuum pressure based on the average. The slope calculation module 67 uses the average in a formula to calculate the average rate of increase of vacuum pressure. The average slope calculation module 67 outputs the average rate of increase of vacuum pressure to the malfunction module 63.

The malfunction module 63 determines if the average rate of increase of vacuum pressure is within a predetermined range. If the average rate of increase of vacuum pressure is not within the predetermined range, the comparing module outputs a malfunction signal 70. More specifically, the malfunction signal 70 may specify over performance or under performance of the purge valve 20.

Figure 3A:
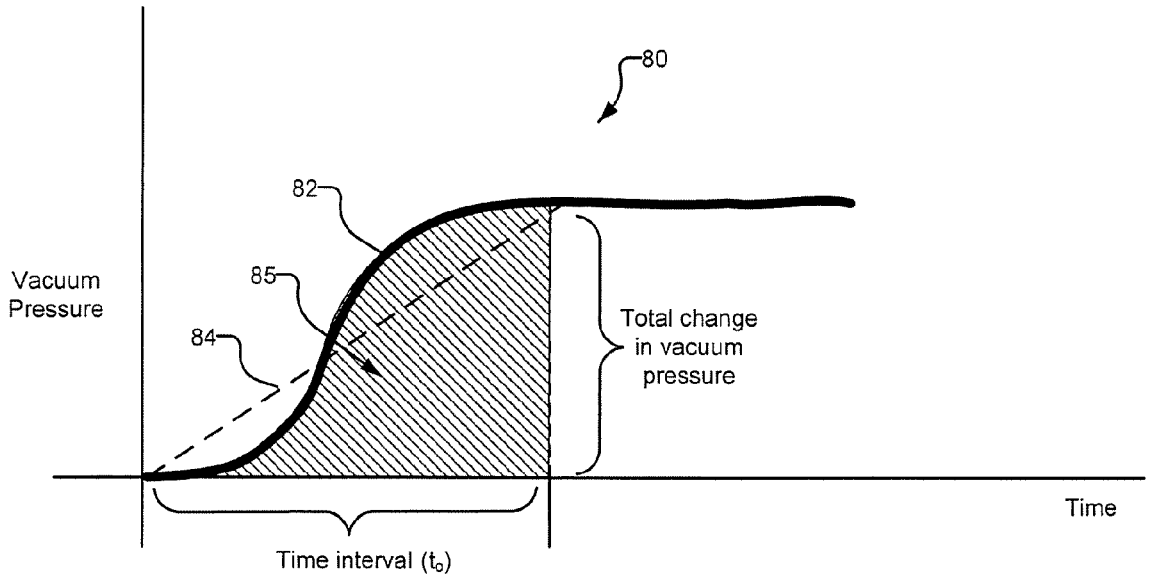
FIG. 3A illustrates the area under a plot of vacuum pressure vs. time according to the present invention.

Referring now to FIG. 3A, a graph 80 illustrates a plot 82 of vacuum pressure in the fuel tank 22 over a time interval. More specifically, the time interval represents the on-time portion of a duty cycle for the purge valve 20. Since the plot 82 is non-linear, an average slope 84 for the plot 82 can be determined by dividing the total change in vacuum pressure by the time interval. An area 85 is defined to be the area under the plot 82.

Figure 3B:
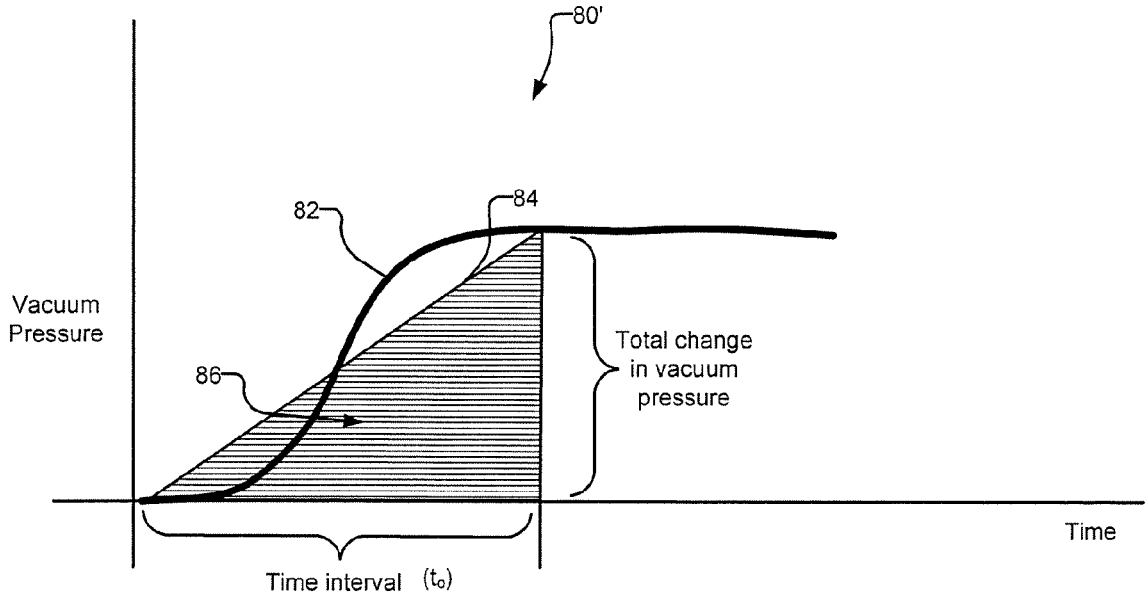
FIG. 3B illustrates an approximation of the area under the plot of vacuum pressure vs. time according to the present invention.

Referring now to FIG. 3B, the graph 80' illustrates an approximation of the area 85 in FIG. 3A. More specifically, the average slope 84 is used to define the hypotenuse of a triangle 86. The area 85, under the plot 82 of each duty cycle, is approximated with triangle 86. An average rate of increase of vacuum pressure is determined based on averaging the area of the triangles 86 from a predetermined number of duty cycles.

Figure 4:
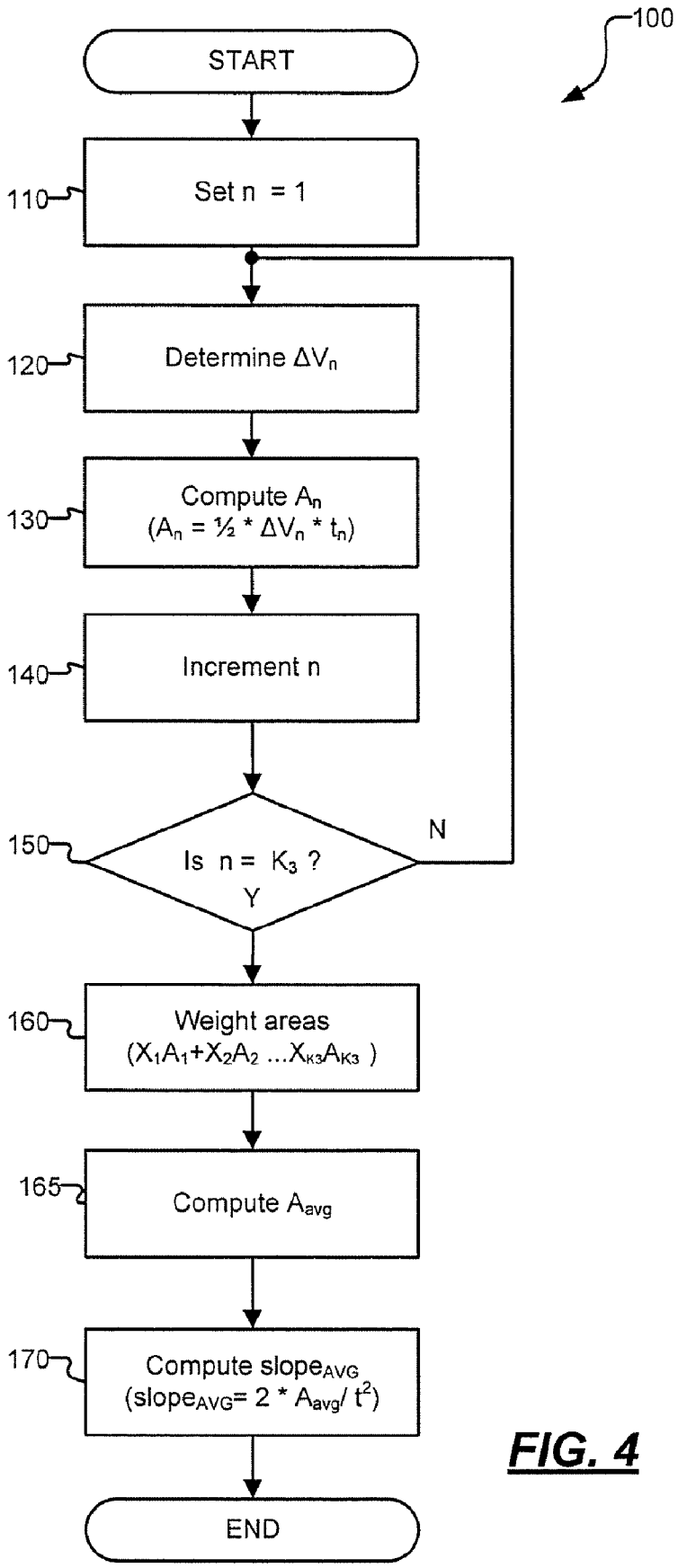
FIG. 4 illustrates a method for calculating the average rate of increase of vacuum pressure according to the present invention.

Referring now to FIG. 4, in an exemplary embodiment according to the present invention, a flow chart describes a method for calculating the average rate of increase of vacuum pressure ($slope_{AVG}$). In step 110, a counter 'n' is set to 1. The counter tracks the number of duty cycles processed.

In step 120, control determines the change in vacuum pressure ($\Delta V_n$) during the on-time of a duty cycle. In step 130, the area 85 is approximated by calculating the area of the triangle ($A_n$) 86 for the duty cycle. According to FIG. 3B, the base of triangle 86 is representative of the on-time of the duty cycle ($t_{on}$), and the height of triangle 86 is representative of the change in vacuum pressure of the duty cycle ($\Delta V_n$).

In step 140, the counter is incremented. In step 150, if counter does not equal the pre-determined number of duty cycles ($K_3$), control proceeds back to step 120 to process another duty cycle. When counter equals $K_3$, control proceeds to step 160. In step 160, the areas of each triangle ($A_1$, $A_2$, . . . $A_{K3}$) 86 is weighted. For example, the area of the triangle 86 for each duty cycle may be weighted according to the order in which the triangles were calculated.

In step 165, control takes an average ($A_{avg}$) of the weighted values. In step 170, control calculates the average rate of increase of vacuum pressure ($slope_{AVG}$) using a derived formula based on the area of a triangle (A=½*base*height) and the slope (s=height/base). In some implementations, the derived formula is: $s=2*(A/b^2)$. Where s is the $slope_{AVG}$, A is $A_{AVG}$, and b is $t_{on}$.

Figure 5:
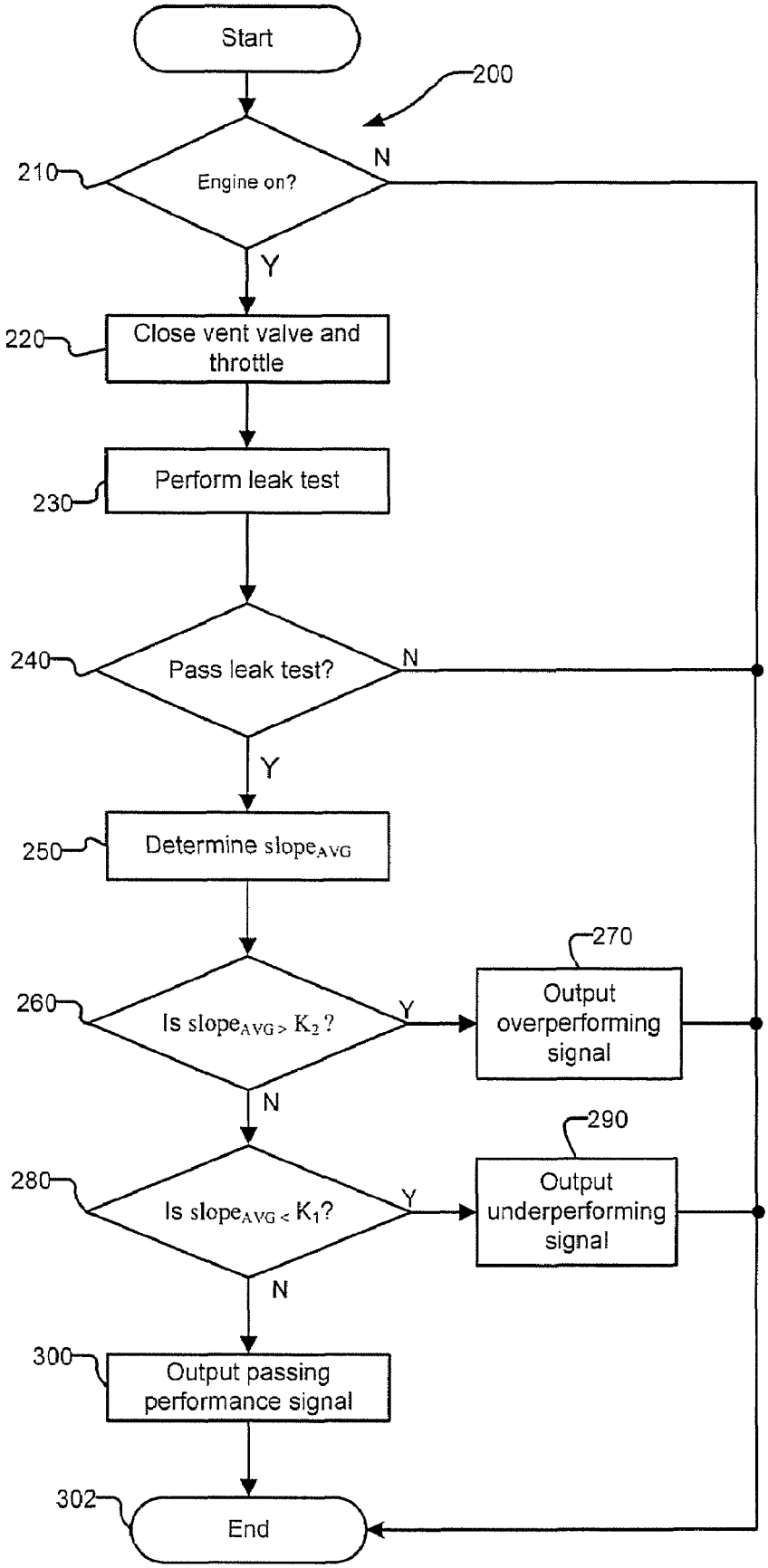
FIG. 5 illustrates a method for detecting a purge valve malfunction according to the present invention.

Referring now to FIG. 5, a method 200 determines the functionality of the purge valve. In step 210, control determines whether the engine is on. When the engine is turned on, control performs certain operations before detecting a malfunctioning purge valve. In step 220, control closes the vent valve 42 and purge valve 20 to seal the EVAP system 14. In step 230, control performs a leak test for the EVAP system 14. In some implementations, the leak test may include one or more types of leak tests. The leak test is performed to ensure the validity of vacuum pressure measurements during the purge valve test.

In step 240, control determines the outcome of the leak test. If the leak test fails, the purge valve functionality test is terminated. If the leak test is passed, control proceeds to step 250. In step 250, control determines the average rate of increase of vacuum pressure ($slope_{AVG}$), as discussed above in FIG. 4. The ECM 40 periodically calculates a minimum ($K_1$) and maximum ($K_2$) value of the average rate of increase of vacuum pressure, based on the data from the fuel vapor sensor 46, the ambient temperature sensor 48, and the MAP sensor 50. In step 260, the $slope_{AVG}$ is compared to $K_2$. If $slope_{AVG}$ is greater than $K_2$, control outputs an overperformance signal in step 270. If $slope_{AVG}$ is less than $K_2$, control determines if $slope_{AVG}$ is greater than $K_1$ in step 280. If $slope_{AVG}$ is less than $K_1$, control outputs an underperformance signal in step 290. If $slope_{AVG}$ is not less than $K_1$, control outputs a passing performance signal in step 300. Control terminates in step 302

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A diagnostic control system for a purge valve that regulates fuel vapor flow from a fuel system into an intake manifold of an engine, comprising:

a calculation module that estimates a plurality of areas based on a plurality of pressure signals and that calculates an average rate of increase of vacuum pressure in the fuel system during operation of the purge valve, wherein operation of the purge valve includes modulating the purge valve between open and closed positions; and a malfunction module that determines whether said average rate of increase of vacuum pressure is within a predetermined range and that generates a purge valve malfunction signal when said average rate of increase of vacuum pressure is not within said predetermined range.

2. The diagnostic control system of claim 1 wherein said calculation module comprises an area calculation module that calculates a plurality of estimated areas based on said plurality of areas.

3. The diagnostic control system of claim 2 wherein said calculation module further comprises an average slope calculation module that determines an average area based on said plurality of estimated areas and that calculates said average rate of increase of vacuum pressure based on said average area.

4. The diagnostic control system of claim 3 further comprising a leak test module that receives a test pressure and that generates a test pass signal when said test pressure signal remains within a range for a predetermined period.

5. The diagnostic control system of claim 4 wherein said calculation module calculates said plurality of areas only upon receiving said test pass signal.

6. The diagnostic system of claim 1 wherein said predetermined range is determined based on manifold air pressure, ambient temperature, and fuel tank pressure.

7. The diagnostic system of claim 1 wherein said purge valve malfunction signal indicates overperformance of the purge valve when said average rate of increase of vacuum pressure is above said predetermined range, an underperformance of the purge valve when said average rate of increase of vacuum pressure is below said predetermined range, and a passing performance when said average rate of increase of vacuum pressure is within said predetermined range.

8. An engine control system comprising the diagnostic control system of claim 1 and further comprising an engine control module that includes said calculation module and said malfunction module.

9. The engine control system of claim 8 further comprising a pressure sensor that generates said plurality of pressure signals.

10. A method of predicting a purge valve malfunction for a fuel system, comprising:

estimating a plurality of areas based on a plurality of pressure signals;

calculating an average rate of increase of vacuum pressure in the fuel system during operation of the purge valve, wherein operation of the purge valve includes modulating the purge valve between open and closed positions;

determining whether said average rate of increase of vacuum pressure is within a predetermined range; and generating a purge valve signal when said average rate of increase of vacuum pressure is not within said predetermined range.

11. The method of claim 10 further comprising calculating a plurality of estimated areas based on said plurality of areas.

12. The method of claim 11 further comprising:

determining an average area based on said plurality of estimated areas; and calculating said rate of increase of vacuum pressure based on said average area.

13. The method of claim 12 further comprising generating a test pass signal when said test pressure signal remains within a range during a predetermined period.

14. The method of claim 13 further comprising calculating said plurality of areas when said test pass signal is generated.

15. The method of claim 10 wherein said predetermined range is based on manifold air pressure, ambient temperature, and fuel tank pressure.

16. The method of claim 10 further comprising:

indicating overperformance of the purge valve when said average rate of increase of vacuum pressure is above said predetermined range; and indicating underperformance of the purge valve when said average rate of increase of vacuum pressure is below said predetermined range, indicating passing performance of the purge valve when said average rate of increase of vacuum pressure is within said predetermined range.

* * * * *